US005899105A

United States Patent [19]

Erhard

[11] Patent Number: 5,899,105

[45] Date of Patent: May 4, 1999

[54] PROCESS FOR MANUFACTURING A SHAPED METAL CAN

[75] Inventor: Patrick Erhard, Sierck les Bains, France

[73] Assignee: Sollac, Puteaux, France

[21] Appl. No.: 08/618,815

[22] Filed: Mar. 20, 1996

[30] Foreign Application Priority Data

Mar. 21, 1995 [FR] France ..... 95 03289

[51] Int. Cl.[6] ..... B21D 51/26

[52] U.S. Cl. ..... 72/370.08; 72/379.4

[58] Field of Search ..... 72/117, 122, 367, 72/370, 379.4, 370.08; 413/1, 69

[56] References Cited

U.S. PATENT DOCUMENTS

| | | | |
|---|---|---|---|
| 1,645,971 | 10/1927 | Riegel . | |
| 2,194,385 | 3/1940 | Dove | 72/120 |
| 4,331,014 | 5/1982 | Miller et al. | 72/93 |

FOREIGN PATENT DOCUMENTS

| | | | |
|---|---|---|---|
| A3 0 356 269 | 2/1990 | France . | |
| C-749 792 | 12/1944 | Germany . | |
| 24 32 300 | 1/1975 | Germany . | |
| 1075856 | 7/1967 | United Kingdom | 72/370 |

*Primary Examiner*—Lowell A. Larson

*Attorney, Agent, or Firm*—Oblon, Spivak, McClelland, Maier & Neustadt, P.C.

[57] ABSTRACT

A process for manufacturing a shaped metal can by carrying out at least one step of locally and successively expanding elementary regions of a peripheral wall.

15 Claims, 4 Drawing Sheets

PROCESS FOR MANUFACTURING A SHAPED METAL CAN

FIELD OF THE INVENTION

The present invention relates to a process for manufacturing a shaped metal can, preferably for a beverage or food, and more particularly to a process for manufacturing a shaped metal can comprising a bottom, a cylindrical peripheral wall in one piece with said bottom and including at least one expanded region, and a lid crimped or seamed onto the peripheral wall.

DISCUSSION OF THE BACKGROUND

It is known in the art to make shaped metal cans consisting of a peripheral wall having at least one expanded region, a bottom crimped or seamed onto one end of the peripheral wall and a lid crimped or seamed onto the other end of said peripheral wall. The lid is provided for example with a device which is easily opened by rupture of a line of reduced strength or for example with a tapped neck for receiving a screwed stopper. The peripheral wall of this type of metal can is generally constituted by a cylindrical sleeve welded longitudinally and including at least one expanded region. Usually the peripheral wall is made from a metal blank of soft steel having a low carbon content and a yield strength of about 250 MPa.

Soft steel of this type permits effecting, without great difficulty, a local expansion of the welded cylindrical sleeve with an expansion ratio calculated from the formula $$\frac{\text{final}\,D - \text{initial}\,D}{D\ \text{initial}} \times 100\%$$

which may be as much as 20%, "initial D" being the initial diameter of the welded sleeve and "final D" being the diameter of the welded peripheral wall after expansion.

To manufacture this type of shaped can, the welded sleeve is produced and expanded locally to form a peripheral wall or skirt comprising at least one expanded region, and the bottom and lid are respectively crimped or seamed onto each end of the peripheral wall.

The expanded region is usually formed by effecting an overall expansion on the whole of the height of the region to be expanded, by a forming process employing air or nitrogen under pressure or by a forming process employing an incompressible fluid or by a mechanical expansion process employing a tool having sectors.

It is also known to make shaped metal cans consisting of, on one hand, a bottom and a peripheral wall in one piece with said bottom and, on the other hand, a lid crimped or seamed onto the peripheral wall. The bottom and the peripheral wall in one piece (integral) with the bottom are made from a cup cut from a metal blank or strip, e.g., either by drawing and redrawing or by drawing and ironing. However, when making this type of can with the drawing and redrawing technique, after the forming of the peripheral wall, the metal is in a highly work-hardened state so that the yield strength of said peripheral wall is about 600 MPa. The possible overall expansion ratio of such a peripheral wall is only about 2.5%. When making this type of can by the drawing and ironing technique, after the drawing of the peripheral wall, the metal is in an even more highly work-hardened state so that the yield strength of the peripheral wall is about 700 MPa and sometimes even more, which imparts to this wall a substantially zero expansion capability. The possible overall expansion ratio of such a peripheral wall is lower than 1% and for very small thicknesses lower than 0.5%. Such low expansion ratios are generally unacceptable and preclude substantial can volume increases and wall thinning.

On the other hand, the advantage of a metal can produced by the drawing and redrawing technique or by the drawing and ironing technique is that it permits very small thicknesses since the metal of the can is very stiff with very high mechanical characteristics, which results in light weight and a low expenditure of material. Further, such a can is made in two parts, the bottom and the peripheral wall being in one piece, which is an advantage from an aesthetic point of view.

OBJECTS OF THE INVENTION

One object of the present invention is to provide a process for manufacturing a shape metal can, preferably of the beverage can type, comprising a bottom and a peripheral wall in one piece with said bottom, said peripheral wall including at least one expanded region whose expansion ratio is about (i.e., ±15% ) 8% in the case of a drawing and redrawing technique and about 3% in the case of a drawing and ironing technique.

DETAILED DESCRIPTION OF THE INVENTION

The invention therefore provides a process for manufacturing a shaped metal can, including beverage cans such as juice, soda, etc. cans currently in use, comprising, on one hand, a bottom and a cylindrical peripheral wall in one piece (ingegral) with said bottom and including at least one expanded region and, on the other hand, a lid crimped or seamed onto the peripheral wall, characterized in that the at least one expanded region is formed by locally and successively expanding at least two elementary regions of the peripheral wall by commencing with a first elementary region closest to the bottom and continuing to a last elementary region which is the furthest from said bottom, said elementary regions partly overlapping one another so as to form said at least one expanded region.

According to other preferred embodiments of the invention a can may be made where the following features are used individually or together:

- at least two expanded regions are formed on the peripheral wall by first of all forming an expanded region which is the closest to the bottom and finally an expanded region which is the furthest from said bottom;
- each elementary region is produced by means of an expansion ring having a shape corresponding to that of said elementary region;
- the diameter of the expansion ring is less than or equal to 4% of the initial diameter of the peripheral wall;
- the pitch of the overlapping of each elementary region is larger than or equal to ⅔ of the height of the expansion ring;
- the depth of each elementary region is less than or equal to ⅙ of the height of the expansion ring.
- the expansion ring has a spherical dome cross-sectional shape;
- the expansion ring has a circular cross-sectional shape;
- the expansion ring has a rectangular cross-sectional shape;
- the expansion ring has a triangular cross-sectional shape;
- the expansion ring is made of elastomer.

Other features and advantages of the invention will be apparent from the following description which is given solely by way of example with reference to the accompanying drawings, in which:

Note that in these Figures the profile of the illustrated shaped cans has been exaggerated purposely for reasons of clarity.

Figure 1:
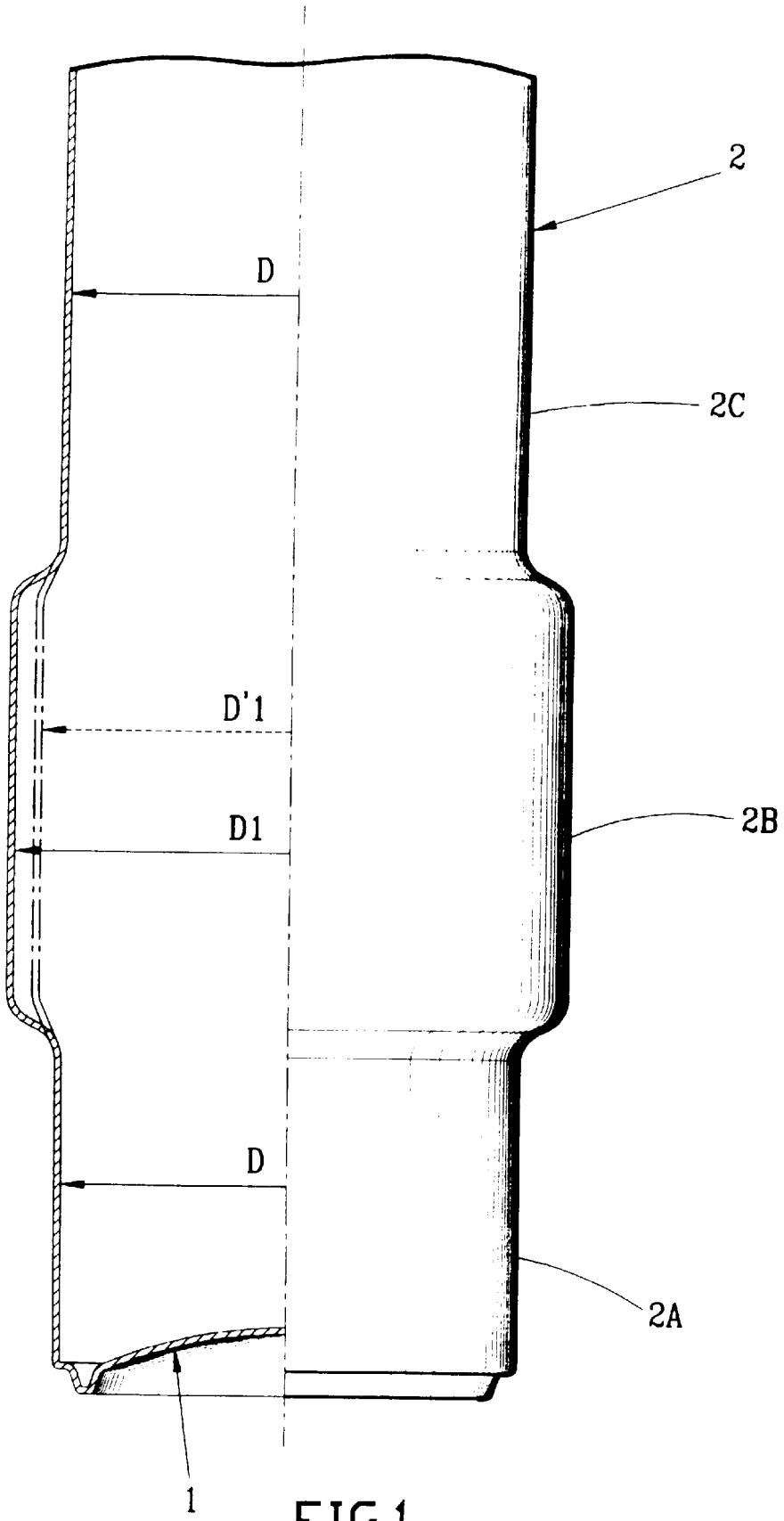
Fig.1 is a longitudinal half-sectional, half-elevational view of a first embodiment of a shaped can obtained by the process according to the invention.
Figure 2:
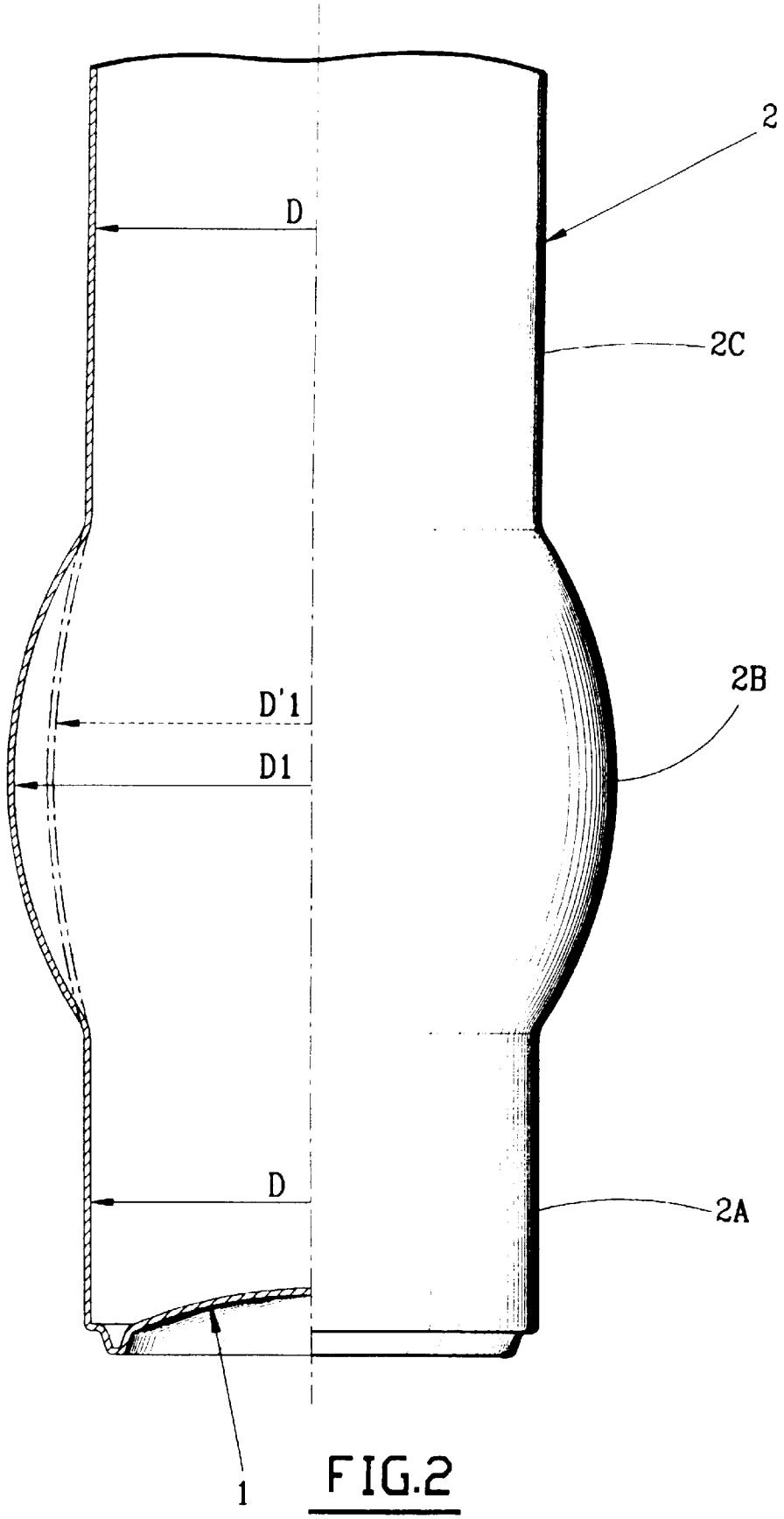
FIG. 2 is a longitudinal half-sectional, half-elevational view of a second embodiment of a shaped can obtained by the process according to the invention.

As shown in FIGS. 1 and 2, the shaped can, here of the beverage can type, comprises a bottom 1 and a peripheral wall 2 in one piece with said bottom 1.

The peripheral wall 2 comprises a succession of regions: a region 2A adjacent the bottom and of diameter D, at least one expanded region 2B situated above the region 2A and of diameter D1, and a region 2C situated above the region 2B and of diameter D.

In the embodiments shown in the Figures, a single expanded region 2B has been shown, but the shaped can may comprise a plurality of expanded regions separated by intermediate regions each having a diameter smaller than the diameter of the expanded regions.

The outside profile of the expanded region 2B may be rectilinear as shown in FIG. 1 or bulging as shown in FIG. 2.

To make such a can, there is formed in a first step from a metal blank of steel, aluminum or aluminum alloy, by drawing and redrawing or by drawing and ironing, a preliminary shape comprising a bottom and a peripheral wall or skirt of diameter equal to the diameter D of the region 2A of the peripheral wall 2 of the shaped can.

Up to the present time, in the course of a second step, the expanded region is formed by effecting an overall expansion on the whole of the height of the region to be expanded, by for example a forming process employing air or nitrogen under pressure or a forming process employing an incompressible fluid, or a mechanical expanding process by means of a tool having sectors.

But the ratio of expansion of the peripheral wall is limited because the metal has been, in the region of this peripheral wall, considerably work-hardened as a result of the forming or the drawing of this peripheral wall.

Indeed, tests have been carried out in starting with a metal blank of low carbon steel which was obtained by cold rolling a hot rolled strip, annealing and cold rerolling having a yield strength of about 400 MPa and the following composition in percentage by weight carbon: 0.008%
manganese 0.139%
phosphorus 0.07%
sulphur: 0.011%
nitrogen: 0.005%
silicon<0.002%
copper: 0.015%
nickel: 0.034%
chromium: 0.009%
aluminum: 0.014%

Shaped cans were prepared from this steel, on one hand, by the drawing and redrawing of a metal blank to form cylindrical preliminary pressings consisting of a bottom and a peripheral wall of diameter D equal to 84 mm and in one piece with said bottom and, on the other hand, by the drawing and ironing of a metal blank to form cylindrical preliminary pressings of diameter D equal to 66 mm, corresponding to conventional beverage cans.

These preliminary pressings were then expanded by an overall expansion on the whole of the height of the region to be expanded.

In respect of the drawn and redrawn cans of initial diameter D equal to 84 mm, there was measured on the preliminary pressings a mean yield strength in the peripheral wall equal to 600 MPa and a mean thickness of the peripheral wall at the center of the region to be expanded equal to 0.15 mm.

After forming the region 2B by an overall expansion, it was found that the maximum diameter it is possible to obtain is 86.1 mm. If the diameter of the can in the expanded region is further increased, the metal of the peripheral wall tears. The thickness of the peripheral wall at the center of the expanded region 2B of diameter 86.1 mm is 0.12 mm.

Therefore, the maximum expansion ratio allowable for such a can is 2.5%.

In respect of drawn and ironed cans of an initial diameter D equal to 66 mm, there was also measured on the preliminary pressings a mean yield strength in the peripheral wall equal to 720 MPa and a mean thickness of the peripheral wall at the center of the region to be expanded equal to 0.145 mm.

After the region 2B has been formed by an overall expansion, it was found that the maximum diameter it is possible to obtain is 66.3 mm, namely a maximum expansion ratio of 0.4%.

In this case, the thickness of the wall at the center of the expanded region 2B was 0.135 mm.

Thus it can be seen that in the case of a shaped can obtained by drawing and redrawing, the ratio of expansion obtained before rupture of the metal is about 2.5% and, in the case of a shaped can obtained by drawing and ironing, the ratio of expansion before rupture of the metal is about 0.4%.

The process according to the invention permits the production of a shaped can having at least one expanded region whose expansion ratio is significantly increased.

Figure 3:
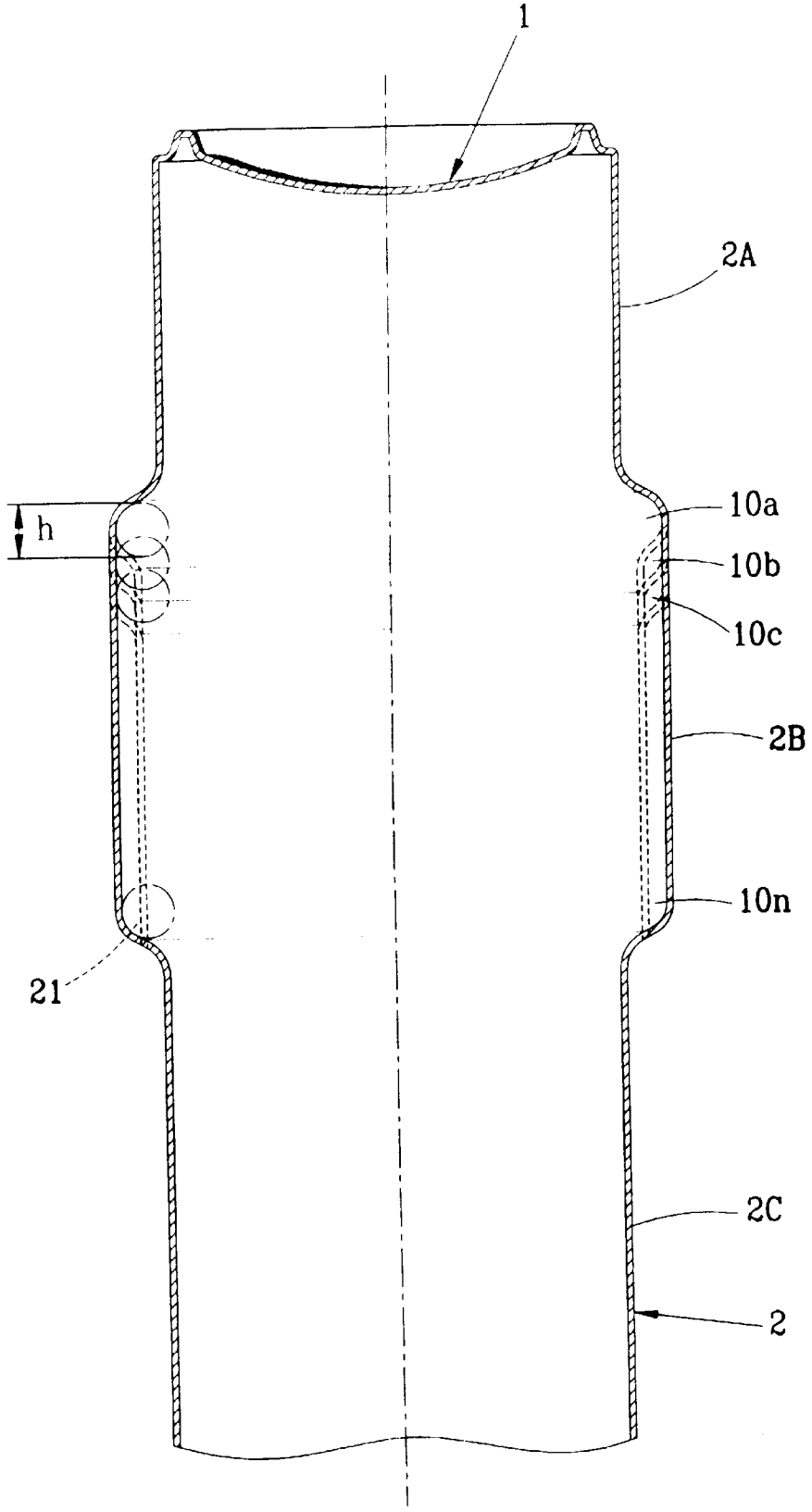
FIG. 3 is a longitudinal sectional view showing an example of the successive steps for forming the expanded region of a shaped can obtained by the process according to the invention.
Figure 4:
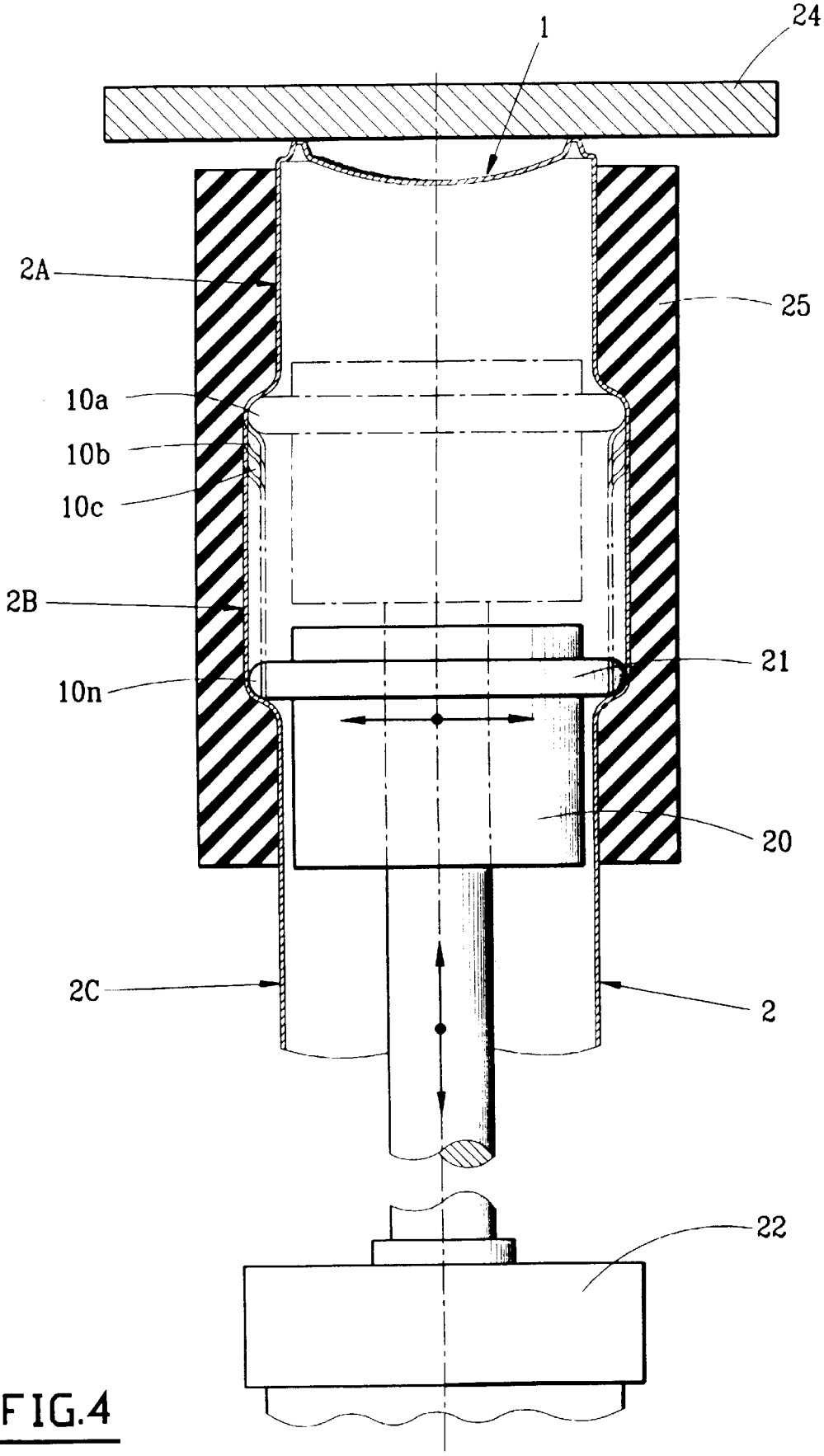
FIG. 4 is a diagrammatic view of an embodiment of a tool for manufacturing a shaped can obtained by the process according to the invention.

For this purpose and as shown in FIGS. 3 and 4, the manufacturing process according to the invention comprises producing the expanded region 2B by employing at least one step comprising locally and successively expanding elementary regions 10*a*, 10*b*, 10*c*. . . 10*n* of the peripheral wall 2 by starting with a first elementary region 10*a* which is the closest to the bottom 1 and continuing to a last elementary region 10*n* the furthest from said bottom.

The elementary regions 10*a*, 10*b*,10*c*. . . 10*n* partly overlap to form the expanded region 2B.

Preferably, the elementary regions 10*a*, 10 *b*, 10*c*. . . 10*n* are formed in a plurality of steps, i.e. in a plurality of successive feeds so as to form, as shown in FIGS. 1 and 2, a first diameter D'1 less than the diameter D1 and so on until the final diameter D1 of the expanded region 2B is obtained.

In the case where the peripheral wall 2 comprises at least two expanded regions, the expanded region closest to the bottom 1 is first of all formed in the manner indicated hereinbefore, and finally the expanded region the furthest from the bottom 1 is formed. Preferably, intermediate expanded regions are formed successively as one proceeds from bottom to top.

As shown in FIGS. 3 and 4, the elementary regions 10*a*, 10*b*, 10*c*. . . 10*n* are formed by means of a tool 20 which includes at its periphery an expansion ring 21 whose shape corresponds to said elementary regions 10*a*, 10*b*, 10*c*. . . 10*n*.

The cross-sectional diameter of the expansion ring 21 is preferably less than or equal to 4% of the initial diameter D of the peripheral wall 2.

Further, the degree of the overlapping of each elementary region 10*a*, 10*b*, 10*c*. . . 10*n* is preferably greater than or equal to ⅔ of the height h of the expansion ring 21, i.e. the degree of the feed of the expansion ring 21 to form each elementary region 10*a*, 10*b*, 10*c*. . . 10*n* is preferably less than or equal to one third of the height h of said expansion ring 21.

Further, the depth of each elementary region 10*a*, 10*b*, 10*c*. . . 10*n* is preferably less than or equal to ⅙ of the height h of the expansion ring 21.

The expansion ring 21 may have a cross section in any desired shape, preferably the shape of a spherical dome, a circular cross section, a rectangular cross section or a triangular cross section, this cross section depending on the profile of the expanded region 2B to be obtained.

Preferably, the material constituting the expansion ring 21 is an elastomer.

The tool 20 may be formed by juxtaposed sectors which are radially movable so as to form, by means of the expansion ring 21, the elementary regions 10*a*, 10*b*, 10*c*. . . 10*n*, and the vertical step-by-step feed of this tool 20 may be controlled for example by a jack 22 (FIG. 4).

The displacements of the tool 20, the expansion and the step-by-step feed may be controlled by a judicious programming within the skill of the ordinary artisan whereby an expanded region 2B may be produced with the desired profile.

During the forming of elementary regions 10*a*, 10*b*, 10*c*. . . 10*n*, the can is preferably maintained by an element 24 applied against the bottom 1, while the end of the peripheral wall 2 remote from said bottom 1 is preferably free (FIG. 4).

Further, a counter-form 25 can be provided around the peripheral wall 2. This counter-form 25 is for example made of elastomer and in this case it is preferably applied directly against the outer surface of the peripheral wall 2, or is made of metal and in this case it preferably defines with the outer surface of the peripheral wall an empty space to permit the expansion of the region 2B.

Tests have shown that the process according to the invention permits increasing the maximum ratio of expansion.

In the case of drawn and redrawn cans, preliminary pressings using the steel described above of diameter D equal to 84 mm and of mean thickness at the center of the region to be expanded equal to 0.15 mm, were expanded by the process according to the invention.

It was found that the maximum diameter it is possible to obtain was 90.5 mm, namely an expansion ratio of 8%.

In this case, the thickness of the peripheral wall 2 at the center of the expanded region 2B is 0.12 mm.

Additional tests were carried out with the same preliminary pressings which were expanded by the process according to the invention to a diameter of 86.1 mm which is equal to the maximum diameter obtained in an overall expansion of the region 2B.

The thickness of the peripheral wall 2 at the center of the expanded region 2B is equal to 0.14 mm, namely 0.02 mm more than if the expansion had been effected in an overall manner throughout the height of the region 2B to be expanded.

These tests show, it is thought, that during the local and successive expansion of the elementary regions 10*a*, 10*b*, 10*c*. . . 10*n* of the peripheral wall, metal flows from the part of the peripheral wall adjacent its free edge toward the region undergoing the local expansion.

In the case of drawn and ironed cans, the preliminary pressings referred to above of diameter D equal 66 mm and of mean thickness at the center of the region to be expanded equal to 0.145 mm, were also expanded by the process according to the invention.

It was found that the maximum diameter it is possible to reach was 68 mm, namely an expansion ratio of 3%.

In this case, the thickness of the peripheral wall 2 at the center of the expanded region 2B is 0.136 mm and the height of the can diminished by 2 mm relative to the height of the preliminary pressing, which is though to clearly show that there is a supply of metal from the part of the peripheral wall adjacent its free edge toward the region undergoing the expansion. The process for manufacturing shaped cans according to the invention therefore permits producing shaped cans with more pronounced bulges from a metal blank of steel, aluminum or aluminum alloy. The tool described above is also part of the invention.

This application is based on French Application 95 03289 filed Mar. 21, 1995 which is incorporated herein by reference.

What is claimed as new and desired to be secured by Letters Patent of the United States is:

1. A process for manufacturing a shaped metal beverage can which comprises a bottom and a cylindrical peripheral wall which said bottom and includes an expanded region, and a lid crimped or seamed onto said peripheral wall, said process comprising the following step:

forming said expanded region by expanding locally successive, overlapping elementary regions of said peripheral wall commencing with a first elementary region closest to said bottom and continuing to a last elementary region furthest from said bottom while said can is maintained by an element applied against said bottom and the end of said peripheral wall remote from said bottom is free, wherein said elementary regions are expanded by means of expansion ring having a shape corresponding to the shape of the elementary region.

2. The process according to claim 1, wherein said can comprises at least two expanded regions which are formed on said peripheral wall by first forming that one of said at least two expanded regions which is the closest to said bottom and finally forming that one of said at least two expanded regions which is the furthest from said bottom.

3. The process according to claim 1, wherein said expansion ring has a cross sectional diameter which is no more than 4% of the non-expanded diameter of said peripheral wall.

4. The process according to claim 1, wherein said elementary regions partly overlap one another to a degree which is no more than ⅔ of the height of said expansion ring.

5. The process according to claim 1, wherein each elementary region has a depth which is no more than ⅙ of the height of said expansion ring.

6. The process according to claim 1, wherein said expansion ring has a spherical dome cross-sectional shape.

7. The process according to claim 1, wherein said expansion ring has a circular cross-sectional shape.

8. The process according to claim 1, wherein said expansion ring has a rectangular cross-sectional shape.

9. The process according to claim 1, wherein said expansion ring has a triangular cross-sectional shape.

10. The process according to claim 1, wherein said expansion ring is made of elastomer.

11. The process according to claim 1, wherein said peripheral wall has a thickness of about 0.15 mm prior to expansion.

12. The process according to claim 11, wherein said can is made by a drawing and redrawing technique and the expansion of locally successive, overlapping regions produces at least one region whose expansion ratio is about 8%.

13. The process according to claim 11, wherein said can is made by a drawing and ironing technique and the expansion of locally successive, overlapping regions produces at least one region whose expansion ratio is about 3%.

14. The process according to claim 1, wherein said can is made by a drawing and redrawing technique and the expansion of locally successive, overlapping regions produces at least one region whose expansion ratio is about 8%.

15. The process according to claim 1, wherein said can is made by a drawing and ironing technique and the expansion of locally successive, overlapping regions produces at least one region whose expansion ratio is about 3%.

* * * * *